United States Patent [19]

Hijikata et al.

[11] 3,952,793

[45] Apr. 27, 1976

[54] MOULDING FLASK FOR VACUUM SEALED MOULDING PROCESS

[75] Inventors: Itsuo Hijikata, Nagoya; Hideto Terada, Toyokawa, both of Japan

[73] Assignee: Sintokogio, Ltd., Nagoya, Japan

[22] Filed: Nov. 26, 1974

[21] Appl. No.: 527,368

Related U.S. Application Data

[62] Division of Ser. No. 329,082, Feb. 2, 1973, abandoned.

[30] Foreign Application Priority Data

Feb. 4, 1972 Japan ..... 47-15117[U]
Mar. 14, 1972 Japan ..... 47-31295[U]

[52] U.S. Cl. ..... 164/160; 164/7; 164/170; 164/37; 164/379; 164/253

[51] Int. Cl.[2] ..... B22C 15/22

[58] Field of Search ..... 425/85; 164/7, 160, 164/253, 22, 169, 170, 171, 379, 383, 255, 62, 61, 34, 35, 36, 37, 70

[56] References Cited

UNITED STATES PATENTS

| | | | |
|---|---|---|---|
| 2,962,776 | 12/1960 | Taccone | 164/170 |
| 3,156,958 | 11/1964 | Miller et al. | 164/170 |
| 3,861,447 | 1/1975 | Hondo | 164/160 X |
| 3,872,915 | 3/1975 | Nokota et al. | 164/160 |

FOREIGN PATENTS OR APPLICATIONS

| | | | |
|---|---|---|---|
| 527,222 | 6/1931 | Germany | 164/170 |

*Primary Examiner*—Ronald J. Shore
*Attorney, Agent, or Firm*—Armstrong, Nikaido & Wegner

[57] ABSTRACT

Moulding flask adapted to be used in a process for forming a mould comprising steps of disposing, at the opening of the moulding flask, a pattern having a shield membrane of synthetic resin on the outer surface thereof, filling the space defined between the moulding flask and the pattern with particulate filler material such as sand, and applying negative pressure to the filler material so that the filler material is subjected to an external pressure to make a mould, said moulding flask having at least one surface on an intermediate partition surface formed by an impervious resilient membrane which is supported by a support member whereby, when the filler material is subjected to the negative pressure, the external pressure is applied to the resilient membrance which then presses the filler material so as to enhance compacting of the mould thus producing a strong and precise casting mould.

3 Claims, 10 Drawing Figures

MOULDING FLASK FOR VACUUM SEALED MOULDING PROCESS

This is a division of application Ser. No. 329,082, filed Feb. 2, 1973, and now abandoned.

The present invention relates to a moulding flask adapted to be used in a mould forming process for forming a mould by filling heat resistant particulate material such as sand in the moulding flask and then applying aa negative pressure to the inside of the moulding flask.

In a conventional moulding process, it has been necessary in order to make a mould to add to moulding sand an inorganic binder such as clay, bentonite and sodium silicate, an organic binder such as oil, dextrin and synthetic resin. For this purpose, it has been required to provide a moulding sand mixer for mixing the sand with the binder. Further, since the sand is strongly bonded by the binder, it has been required to use a shake-out machine or a knock-out machine for knocking-out the mould after use. Further, for the purpose of sand reclamation, the sand must be cleaned by a sand reclamation apparatus. These operations, however produce dust, waste, noise and vibrations which must be eliminated by additional expensive means.

In order to eliminate the aforementioned disadvantages of the conventional moulding process, there has been proposed in Japan to employ a quite novel metal casting process which employs a novel mound forming method. The present invention relates to a moulding flask for use with such a novel mould forming method. Therefore, the present invention will better be understood when it is described after the novel metal casting process is fully described.

The novel metal casting process of this invention is characterized by the fact that no binder is used with sand for forming a mould. The process uses a pattern plate having a pattern provided thereon, the surface of which is then covered by a shield membrane of synthetic resin. The pattern plate is thereafter disposed at the opening of a moulding flask defining a space between the moulding flask and the membrane covering the pattern plate. Then, the space is filled with heat resistant particulate material such as sand. The heat resistant particulate material is charged into the space through another opening provided in the moulding flask. This opening is covered after the space is filled by the particulate material, by means of a flexible membrane made of a suitable material such as plastic or rubber. Thereafter, the moulding flask having the particulate material charged therein is subjected to a negative pressure to apply an external pressure to the flexible membrane at said other opening so as to apply a compacting force to the particulate material. Thereafter, the pattern plate is removed from the moulding flask, the membrane thereon being left on the particulate material by attracting it by means of the negative pressure acting on the mould surface. The membrane left on the mould surface forms, a cavity, and may be melted by the heat given from the molten metal which is poured into the cavity, but the molten membrane is allowed to permeate into the compacted particulate material to seal the gap between the grains of the particulate material. Thus, the negative pressure acting on the particulate material is maintained and the mould is not broken. In removing a casting product from the mould, it is only necessary to remove the negative pressure but there is no necessity for applying an external force. Thus the particulate material is loose and the mould is broken. Therefore, the casting product can be readily be taken out of the mould. In knocking out the mould, no noise, vibration or bad odor are produced and the recovered particulate material which is loose can be immediately utilized in the next mould forming process. Since the particulate material is free from moisture and binder, the casting product thus obtained is free from any defects such as blow holes or the like. Thus, it is possible to obtain a product of a smooth and precise casting surface. The mould forming method used in the novel metal casting process may be referred to as a "vacuum sealed moulding process."

The present invention relates to a moulding flask for use in the vacuum sealed moulding process. It has been found that a conventional moulding flask for use in the vacuum selaed moulding process has inherent disadvantages. In fact, when the pattern plate is removed from the mould, the mould surface is often deformed. One of the causes of the deformation is that the particulate material is not uniformly charged in the moulding flask. Further, before the pattern plate is removed, the particulate material charged in the mould flask is subjected to a pressure applied from the flexible membrane covering the particulate material supply opening but, after the pattern plate is removed, the membrane left on the compacted particulate material is subjected to an atmospheric pressure. This sudden change of external pressure may be another cause of the deformation.

The inventors have effectively solved the above problems inherent to the moulding flask for the vacuum sealed moulding process and accomplished a novel moulding flask which is free from the above problems. According to the present invention, the deformation of the mould is eliminated by resilient gas impervious membrane means provided on at least one surface of the moulding flask or on an intermediate partition surface, and a support member provided outside the membrane means and capable of applying an external pressure to the membrane means whereby when the particulate material charged in the moulding flask is subjected to a negative pressure, the particulate material is also compressed by an external pressure acting on the membrane means so as to make the compacted mould. The present invention is characterized by the fact that a fixed wall in a conventional moulding flask is substituted by a resilient membrane in order that the external pressure is effectively utilized.

The present invention will now be described with reference to preferred embodiments which are shown in the accompanying drawings, in which.

Figure 1:
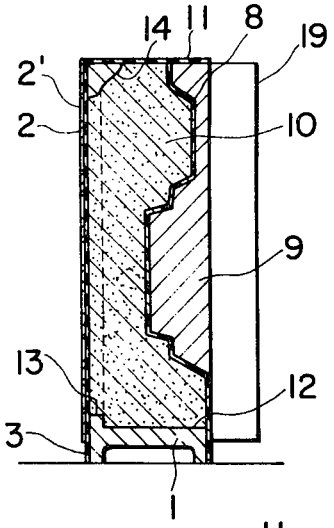
FIG. 1 is a sectional view of a moulding flask for a vacuum sealed moulding process embodying the features of the present invention.
Figure 2:
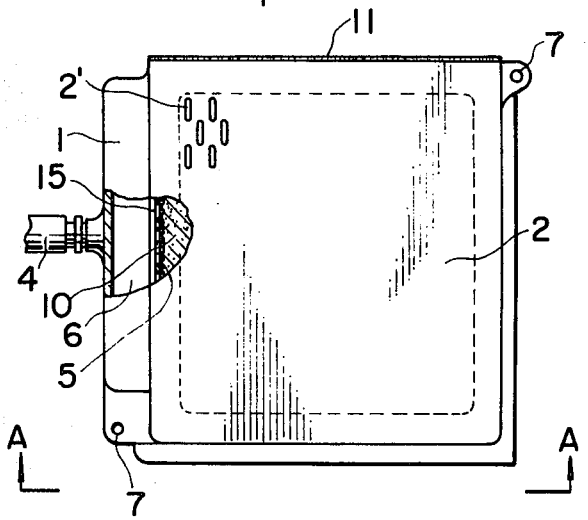
FIG. 2 is a partially broken plan view of the moulding flask shown in FIG. 1.
Figure 3:
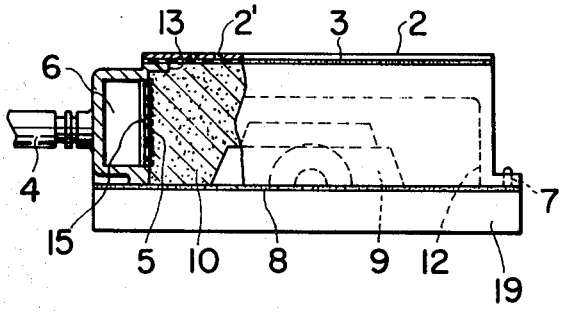
FIG. 3 is a view of the moulding flask as seen along the arrow A — A in FIG. 2.
Figure 4:
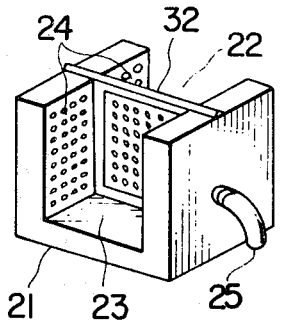
FIG. 4 is a perspective view of another embodiment of the present invention showing a moulding flask having a pair of openings at the opposite sides for disposing pattern plates.
Figure 5:
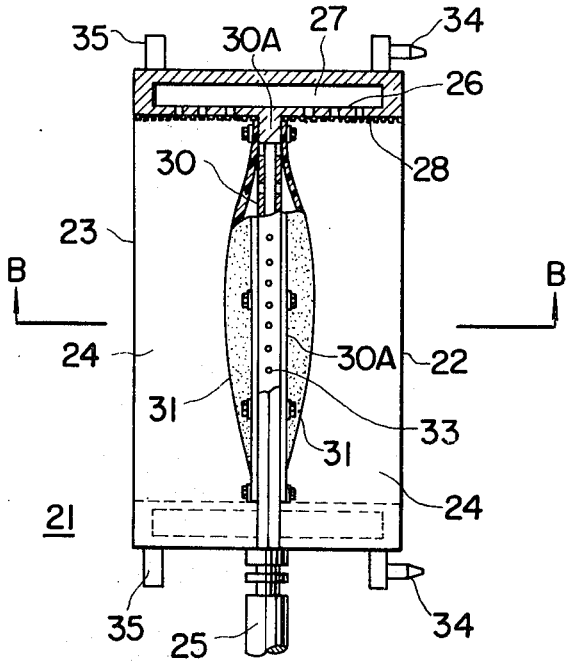
FIG. 5 is a partially broken plan view of the moulding flask shown in FIG. 4.
Figure 6:
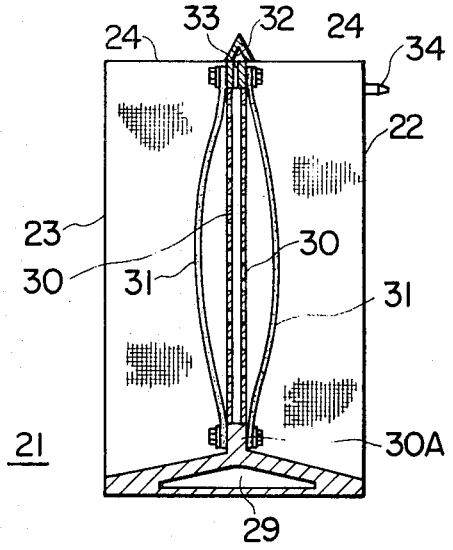
FIG. 6 is a sectional view of the moulding flask taken along the line B — B in FIG. 5.
Figure 7:
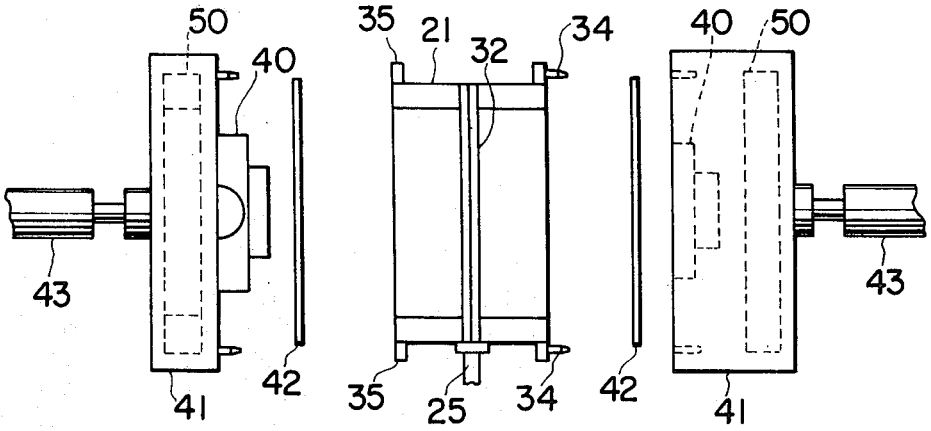
FIG. 7 is a diagrammatical view showing the mould forming process using the moulding flask shown in FIG. 4.

Referring to the drawings, particularly to FIGS. 1 to 3, there is shown a moulding flask for use in a vacuum sealed moulding process. In the drawings, the reference numeral 1 designates a frame having an opening 12 for receiving a pattern plate, an opening 13 opposite to the opening 12, and an opening 14 provided in the upper side of the frame for supplying particulate material therethrough. An impervious resilient membrane 3 is provided so as to cover the opening 13 and, at the outside of the membrane 3, there is disposed a perforated plate 2 which has a plurality of perforations 2'. The frame 1 is further provided with a suction hose 4 which on one hand communicates with the interior of the frame and on the other hand connected through a valve with a suction pump. A fine mesh wire screen 5 is provided in the frame at the side where the suction hose 4 is connected. The screen 5 is supported by a lattice like support member 15 at a position spaced from the inner surface of the frame 1. A chamber 6 is formed behind the screen 5. The reference numeral 7 designates a locating hole provided in the frame 1 for locating the pattern plate.

A vacuum sealed moulding process using the moulding flask thus formed will now be described. A pattern plate 19 having a pattern 9 is located in the opening 12 by means of the locating hole 7. The pattern 9 has a membrane 8 of a synthetic resin attracted to the surface of the pattern 9 under a suction force. Then, particulate material 10 is supplied into the frame 1 through the opening 14. The frame 1 may be subjected to vibration during this material supplying step by means of a vibrator means (not shown) or the like so as to ensure uniform charging of the particulate material 10. Then, the opening 14 of the frame 1 is covered by a resilient membrane 11 and the suction pump communicating with the suction hose 4 is operated to evacuate the interior of the frame 1 through the chamber 6. Thus, the particulate material 10 in the frame 1 is compressed by the external pressure which acts on the material through the membranes 3 and 11. Thereafter, the pattern plate 19 is removed from the frame 1. In this instance, the membrane 8 is left on the particulate material 10 by being attracted thereto by the negative pressure in the frame 1. In the illustrated embodiment, the perforated plate 2 and the membrane 3 are provided only on one side of the frame 1, however, it should be noted that a similar arrangement may be made on another side thereof. Further, it may also be possible to substitute the perforated plate 2 by a screen or a plurality of spaced apart rods secured to the frame 1.

As described above, the frame 1 is provided on at least one of its surfaces with an imprevious resilient membrane which is supported by a support membrane such as a perforated plate 2 which can transmit the external pressure to the membrane. Thus, when the negative pressure is applied to the interior of the frame 1 the external pressure acts on the particulated material 10 in the frame 1 through an increased area as compared with a known flask. Thus, the particulate material can be compacted by a more compressive force. Further, since the membrane is supported by the perforated support member, the membrane is not subjected to an expansion when the particulate material is charged. Thus, there is no danger that the membrane is broken due to the internal pressure applied by the particulate material. Therefore, an effective moulding flask for vacuum sealed moulding process can be provided.

In the embodiment shown in FIGS. 1 to 3, the moulding flask is so formed that the pattern plate is disposed at only one side thereof. FIGS. 4 to 10 show another embodiment of the present invention in which the moulding flask for vacuum sealed moulding process is so constructed that a pair of casting moulds are simultaneously formed at the opposite sides of the moulding flask. In this type of arrangement, since the opposite sides of the moulding flask are closed by the pair of pattern plates, the external pressure cannot act on the particulate material from the sides where the pattern plates are disposed. Therefore, compacting operation may be performed only by the external force acting on the particulate material through the material supply opening, and a perfect compacting cannot be expected. Further, when the pattern plate is removed from the moulding flask, the mould surfaces are suddenly subjected to the external pressure and may be deformed thereby.

According to the illustrated embodiment, the aforementioned disadvantages are eliminated by a pair of impervious membranes disposed at an intermediate position between the two pattern plates, so that the external pressure can be introduced into a space between the membranes to act on the particulate material in the flask.

Referring to the drawings, the flask includes a frame 21 having a pair of openings 22 and 23 at the opposite sides thereof for receiving the pattern plates. The frame 21 is further provided at the upper side with a pair of material supply openings 24 for supplying therethrough heat resistant particulate material such as sand, and also connected at the other side with a suction hose 25 which communicates the interior of the frame 21 with a suction or vacuum pump through a valve. At the inside of the opposite end walls of the frame 21, there are provided a pair of perforated plates 26 which form a pair of chambers 27 between the end walls and the perforated plates 26. A screen 28 of a fine mesh is disposed at the inside of each perforated plate 26. The chambers 27 are connected with each other through a communicating chamber 29 formed in the bottom of the frame 21. Between the perforated plates 26, a pair of parallel perforated partition plates 30 are secured by means of projections 30A formed in the intermediate portions of the perforated plates 26. Thus, the interior of the frame 21 is divided into two parts by the perforated partition plates 30 and further a space is provided between the partition plates 30.

At the outside of each perforated plate 30, there is disposed an imperious resilient membrane 31. A cover 32 of an angle member is provided at the upper portions of the perforated plates 30 in such a manner that the space between the perforated plates 30 is opened to the atmosphere through perforations 33 formed in the projection 30A at the upper portion of the frame 21, and through the interior of the cover 32. In the drawings, the reference numeral 34 designates guide pins for locating the pattern plates. The reference numeral 35 designates bushes having guide holes.

Figure 8:
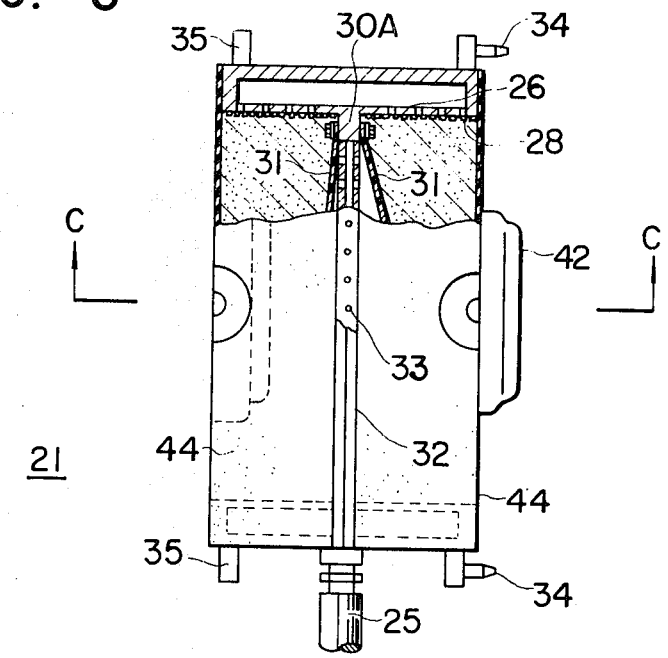
FIG. 8 is a partially broken away plan view of the moulding flask after the mould forming process shown in FIG. 7.
Figure 9:
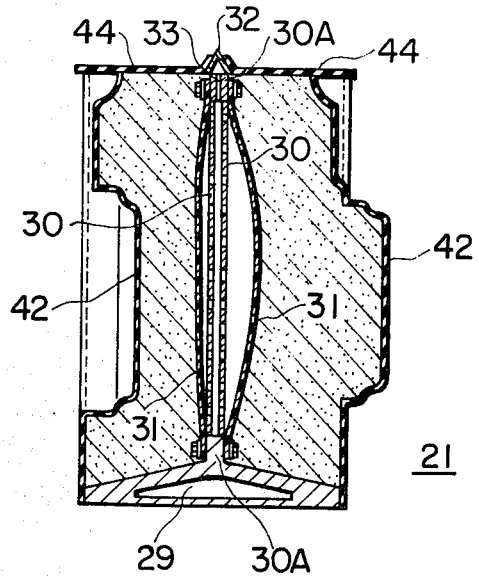
FIG. 9 is a sectional view taken along the line C — C in FIG. 8.
Figure 10:
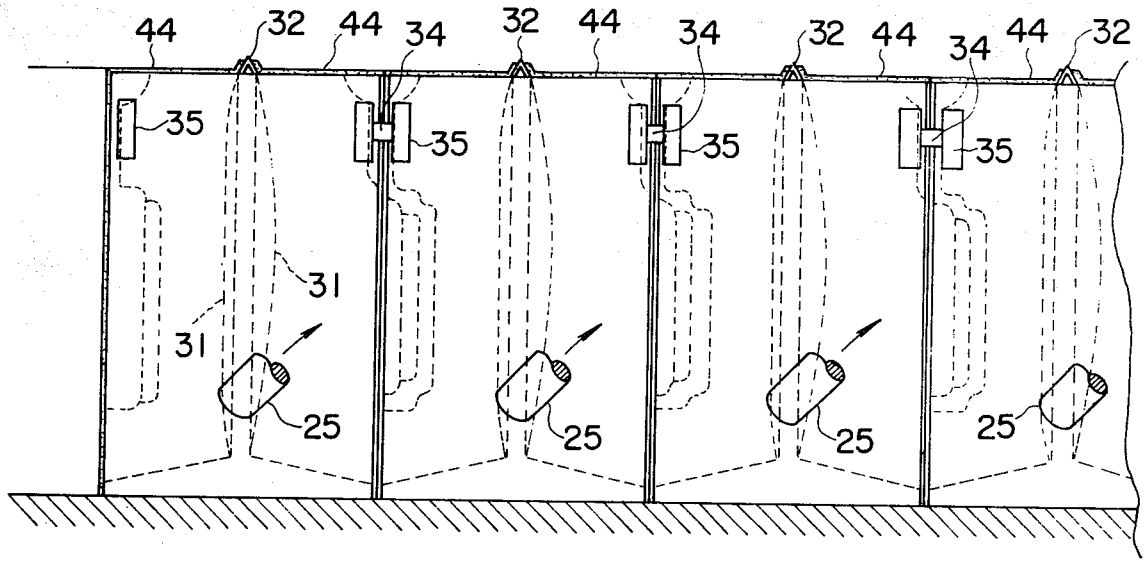
FIG. 10 is a front view of the assembled moulding flask after the mould forming process shown in FIG. 7.

A vacuum sealed moulding process using the moulding flask thus formed will now be described. A pair of pattern plates 41, each having a pattern 40, are located at opposed positions in the moulding flask. Each of the patterns 40 has a resilient membrane 42 at its surface, which is held thereon by a suction pressure applied to a chamber 50 provided in each of the pattern plates 41. The pattern plates 41 are so disposed that they are in opposed relation to the openings 22 and 23 of the frame 21 and thereafter fluid pressure operating cylinders 43 are actuated to advance the pattern plates. Thus, the pattern plates 41 are located in the openings 22 and 23 of the frame 21. Thereafter, particulate material is charged through the upper openings 24 into the frame 21 the openings 24 are covered by membranes 44. Then, the chambers 27 are evacuated by the vacuum pump through the suction hose 25 by operating an associated valve not shown so as to apply a negative pressure in the frame 21. Thus, the interior of the frame 21 is evacuated and the atmospheric pressure is applied to the charged material through the membrane 44. At the same time, the atmospheric pressure is introduced through the interior of the cover 32 and the perforations 33 in the projection 30A to the space between the perforated plates 30, and acts on the charged material through the membranes 31. Thus, the material is sufficiently compacted. Then, the fluid pressure operating cylinders 43 are actuated in the reverse directions to remove the pattern plates 41 from the frame 21. In this instance, the suction pressure applied to the chambers 50 in the pattern plates 41 are released and a slight air pressure is applied to the pattern plates 41 so that the membranes 42 are separated from the pattern plates 41 and left on the charged material in the frame 21. When the pattern plates 41 are thus removed from the frame 21, moulds are formed in the frame 21 as shown in FIGS. 8 and 9. The frame 21 having moulds is then transferred to another position where the frame 21 is assembled with other frames by means of the guide pins 34 and the bushes 35 so as to form a casting cavity as shown in FIG. 10. The perforated partition plates 30 are provided as support members for preventing the membranes 31 from being deformed when the heat resistant particulated material such as sand is charged into the frame 21. The perforated plates 30 may be substituted by screens or a plurality of parallel rods.

As described above, since the frame is made with a top and a pair of opposing sides having an open structure and provided at the central portion thereof with a pair of impervious resilient membranes positioned with a suitable spacing with support members interposed therebetween, it is possible to apply atmospheric pressure to the charged material over a substantial area, so that the charged material can be compressed with sufficient compactness. Therefore, it is possible to obtain a precise mould having sufficient strength. Although, in the illustrated embodiments, the negative pressure is applied to the material charged in the mould flask through a chamber or chambers, it is of course possible to provide a suction hose at other appropriate positions on the frame for directly evacuating the moulding flask.

The present invention has thus been shown and described with respect to preferred embodiments but it should be noted that the invention is in no way limited to the details of the illustrated structures and various changes and modifications may be made without departing from the scope of the appended claims.

We claim:

1. A molding flask for use in a vacuum sealed molding process comprising a frame having two openings disposed opposite to each other and closable by pattern plates covered by a shield membrane of synthetic resin which forms a mold surface; a pair of spaced impervious resilient membranes disposed between said two openings; a pair of spaced supporting means disposed between said pair of spaced membranes whereby each of the supporting means supports respectively each of the spaced membranes at the outside thereof, said spaced membranes and said supporting means dividing the interior of the flask into two parts; at least one opening disposed at each of said parts for supplying charging material into each of said parts; means for transmitting atmospheric pressure into the space between the supporting means whereby the outside of each spaced membrane is subjected to the atmospheric pressure; and at least one opening disposed at each of said parts for communicating with a vacuum source, said source being protected against ingressing of the charged material, and whereby said charged material in each of said two parts is subjected to reduced pressure.

2. A molding flask in accordance with claim 1 in which said flask is further provided with a chamber to prevent the charging material from entering thereinto but communicated with the two parts of the flask, and a suction hose leading to the vacuum source and connected to the chamber, whereby reduced pressure is applied to the charged material in the two parts of the flask.

3. A molding flask in accordance with claim 1 wherein said openings for charging material into each of the parts is closed by a resilient impervious membrane.

* * * * *